United States Patent [19]

Bernard

[11] 4,270,780

[45] Jun. 2, 1981

[54] DOOR FASTENER

[75] Inventor: Pierre J. Bernard, Versailles, France

[73] Assignee: La Telemecanique Electrique, France

[21] Appl. No.: 50,857

[22] Filed: Jun. 21, 1979

[30] Foreign Application Priority Data

Jun. 21, 1978 [FR] France ..... 78 18517

[51] Int. Cl.[3] ..... E05B 13/10; E05B 65/06; E05C 3/04; E05C 3/06

[52] U.S. Cl. ..... 292/202; 70/135; 70/139; 70/210; 70/216; 292/347; 292/356; 292/DIG. 64

[58] Field of Search ..... 70/DIG. 31, 139, 216, 70/135, 84, 137, 209, 215, 210, 449, 451; 292/347, 356, 359, 202, DIG. 53, DIG. 64

[56] References Cited

U.S. PATENT DOCUMENTS

| | | | |
|---|---|---|---|
| 1,333,189 | 3/1920 | Shaw | 70/216 X |
| 1,654,489 | 12/1927 | Teich | 70/216 |
| 1,739,510 | 12/1929 | Hart et al. | 70/216 |
| 1,920,848 | 8/1933 | Diehl | 70/216 |
| 2,201,957 | 5/1940 | North | 70/216 |
| 2,313,840 | 3/1943 | Pleasant et al. | 292/347 UX |
| 2,427,909 | 9/1947 | Howell | 70/216 |
| 2,800,350 | 7/1957 | Keeler | 70/210 X |
| 3,541,817 | 11/1970 | Morris et al. | 70/216 |
| 3,930,390 | 1/1976 | Keller | 70/451 X |
| 3,951,444 | 4/1976 | Shull | 292/359 |

FOREIGN PATENT DOCUMENTS

| | | | |
|---|---|---|---|
| 224399 | 9/1943 | Austria | 70/139 |
| 299975 | 9/1954 | Switzerland | 70/139 |
| 643258 | 9/1950 | United Kingdom | 70/216 |
| 657007 | 9/1951 | United Kingdom | 70/210 |

*Primary Examiner*—Roy D. Frazier
*Assistant Examiner*—Carl F. Pietruszka
*Attorney, Agent, or Firm*—William A. Drucker

[57] ABSTRACT

A fastening device for a door permits the actuation thereof by a handle, a locking element, or a key of normal kind. A bearing, fast to the wall of the door, can receive either a standard shaft, or a lock cylinder, or again a shaft having a head of particular shape, each of these three members being associated with a same operating handle and a same bolt.

8 Claims, 9 Drawing Figures

DOOR FASTENER

The invention relates to a fastener for a door or the like comprising: a bearing fast with the wall of this latter, a rotary lock operating member pivoted in this bearing and having a first extremity accessible from one side of the wall of the said door and a second extremity placed at the opposite side and equipped with a bolt, and a handle for operating the lock and the door disposed about the first extremity of the lock operating member.

BACKGROUND OF THE INVENTION

This kind of device which finds its principal use in the closing of doors of cabinets containing apparatus for control of industrial electrical installations, is known for example from the French Pat. No. 1275620, wherein the locking member described can be actuated when the key is introduced into an associated lock.

Such installations are nevertheless subjected to handling by service or maintenance personnel whose respective competence is not equal, and it thus becomes of importance either to be able to prevent certain access, or to limit these occasions of handling to only certain cabinets, or again to permit any person to handle them when these cabinets contain only apparatus or circuits which are not dangerous.

The concern for rationalisation and normalisation of industrial apparatuses formulated by the users moreover leads the manufacturers to provide products having comparable functions and capable of being manufactured starting from elements which are as standardised and are as few in number as possible.

OBJECT OF THE INVENTION

The invention accordingly proposes to provide a fastening device in which the number of elements will be reduced, and in which the simple choice of an operating member, among a limited number of models, will permit to render the operation thereof possible, either by any person, or by those holding a normal key, or again by those who possess a special key.

SUMMARY OF THE INVENTION

According to the invention, this result is obtained by means of the fact that:

the handle can assume either a first state for which an angular movement with respect to the wall can be effected between two extreme positions, or a second state for which this handle is immobilised with respect to the said wall, the bearing is formed to receive either a first type of lock operating member having means for coupling with the said handle, or a second type of lock operating member not having any means for coupling with the said handle and provided with a head of special shape adapted to receive a removable tool of normal shape, and that the handle has, on the one hand, a cylindrical opening traversed by the lock operating member, and on the other hand a housing coaxial with the opening provided with notches disposed in such a manner that the said coupling means cooperate with the notches when a first lock operating member is disposed in the bearing, and that the said head of special shape is placed in the said housing when a second lock operating member is disposed in the bearing.

BRIEF DESCRIPTION OF THE DRAWINGS

Other interesting features of the invention will be more readily apparent from reading of the description and examination of the drawings, wherein.

DESCRIPTION OF THE PREFERRED EMBODIMENT

Figure 1:
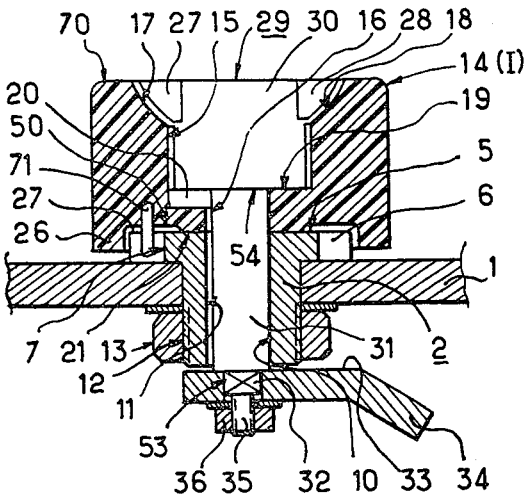
FIG. 1 shows a device the operation of which is not associated with the use of a key.
Figure 2:
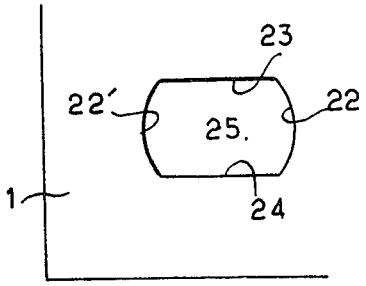
FIG. 2 shows the shape of the opening formed in the door to receive the device.

The wall 1 of a door, or other closure panel, visible in FIG. 1, is provided with an opening 25 such as that shown in FIG. 2, the periphery of which comprises two circular portions 22',22 and two parallel portions 23,24.

A bearing 2 which passes through this opening is angularly fast with the wall by means of flats 23,24 and is made axially fast with the aid of a nut 13 engaged on the threaded portion 12 of the bearing, and of a collar 5 placed at the external face of the wall.

This bearing comprises a cylindrical opening 10 which passes through it, and a throat 11 parallel to the axis of the bearing. The collar 5 which has a generally annular shape comprises at its periphery a first circumferential cutout 7 extending over an angular portion determined by the stops 8 and 9, and a second cutout 6 of small width.

Figure 3:
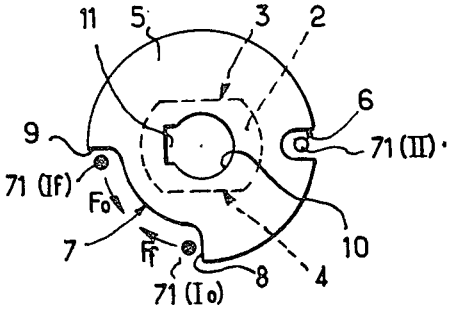
FIG. 3 illustrates an axial view of the bearing.
Figure 4:
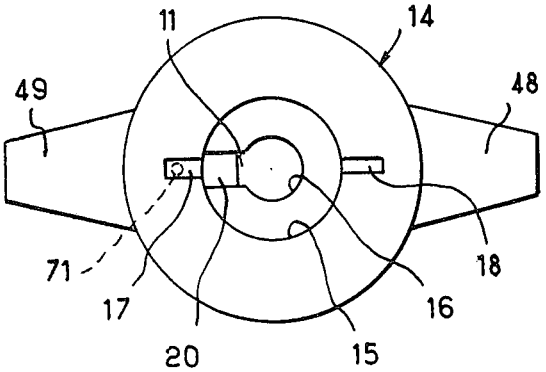
FIG. 4 illustrates an axial view of the operating handle.
Figure 7:
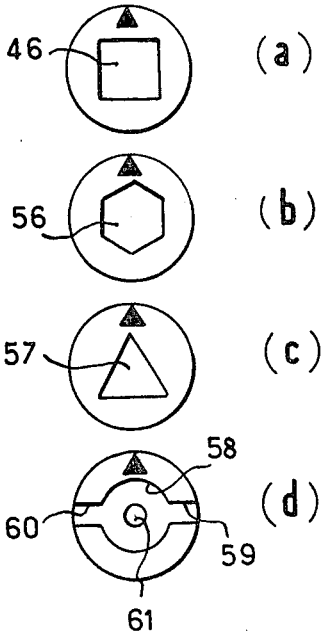
FIG. 7 shows the shapes of the normal heads.

An operating handle 14 shown in FIG. 4 and comprising for example two arms 48,49 has a cylindrical opening 16 and a cylindrical housing 15 coaxial with the opening and of greater diameter than the latter. The base 19 of this housing has a radial notch 20 while the region of the said housing opposite to the base and opening at the surface 70 of the handle comprises two diametrically opposed cutaways 17,18. The side of the handle opposite to the surface 70 (see FIG. 1) comprises a bearing surface 21 intended to bear on the collar 5 and a cylindrical skirt 26 which bounds an internal space 27 intended to receive the collar; the base 50 of this space receives a pin 71 which is parallel to the axis of the bearing and which is placed at such a distance from the latter that it can enter one of the cutouts 6 or 7, see likewise FIG. 3.

When the handle is presented in such a manner that the pin enters the cutout 7, the handle is in a first state which permits its angular displacement in the direction $F_o$ or $F_f$, the pin coming up at the end of its movement against the stops 8,9 into positions represented by 71 ($I_o$) and 71 ($I_f$) in FIG. 3.

On the other hand, when the pin is placed in the cutout 6 in position 71 (II), the handle is then in a second state for which any angular displacement with respect to the wall is prevented.

The two elements which have just been described will always be used in the different modes of construction of the fastening device, each calling for a different locking member.

Referring to FIG. 1, it can be seen that a first lock operating member has been introduced into the handle and into the bearing. This first member 29 comprises a cylindrical portion 31 pivoted in the bearing, a cylindrical head 30 of greater diameter which becomes placed in the housing 15 and gives axial support of the handle in cooperation with the plane portion 33 of a bolt 34 which is supported by means of a squared opening 53 joined to a square-based prism 32 placed at the extremity opposite to the head; a nut 36 engaged on the threaded portion 35 of this extremity provides the locking of the assembly.

Furthermore, two diametral ears 27,28 of the head 30 engage into the respective cutaways 17 and 18 and thus assure an angular coupling of the handle and of the locking member.

The actuation of the handle causes therefore the rotation of the lock operating member and, consequently, of the bolt between the limits defined above.

In this type of construction, the notch 20 and the groove 11 do not have any function and the device can be operated and put into use by any person.

Figure 5:
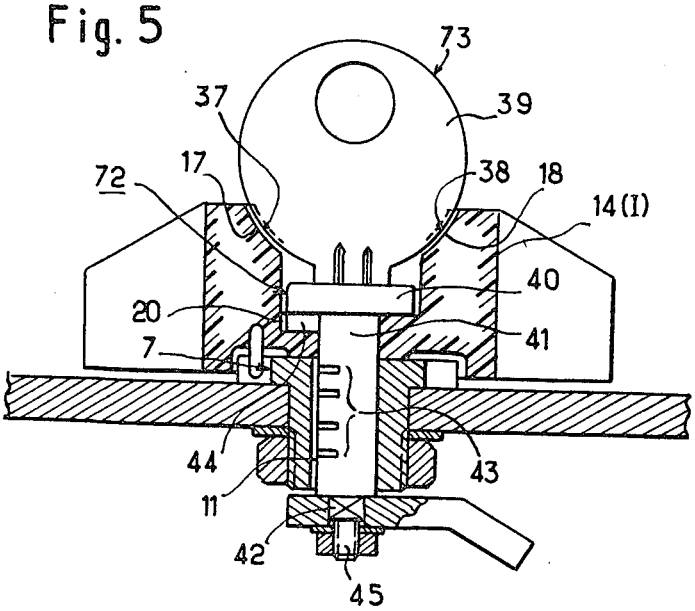
FIG. 5 shows a device the operation of which is only possible with the aid of a special key.

In another type of construction, with which the handle is always in the first state, and illustrated in FIG. 5, the first member is constituted by a locking cylinder 72 comprising a cylindrical barrel 41, a square 42 and a threaded portion 45 of external dimensions identical to those of the parts 31,32,35 which have just been described.

On the other hand, the collar 40 which places itself in the housing 15 does not extend up to the level of the notches, and has a tenon 44 which engages through the notch 20; furthermore, the barrel 41 is equipped with tumblers 43 serving to engage in the groove 11 of the bearing in a predetermined relative position of these elements, in the absence of the key.

A key 73 can be introduced into the cylinder and is then orientated, by reason of the cooperation between 20 and 44, in such a manner that its operating portion 39 engages its opposed edges 37,38 in the cutaways 17,18.

The angular coupling between the lock operating member 72 and the handle which has been partially assured by 20 and 44 is thus completed by the engagement of the edges 37,38 in the notches and permits the transmission of a large turning couple to the lock operating member.

It is clear that the tumblers 43 will be able to engage in the groove 11 for one of the positions of the handle defined by the stops 8,9.

Figure 6:
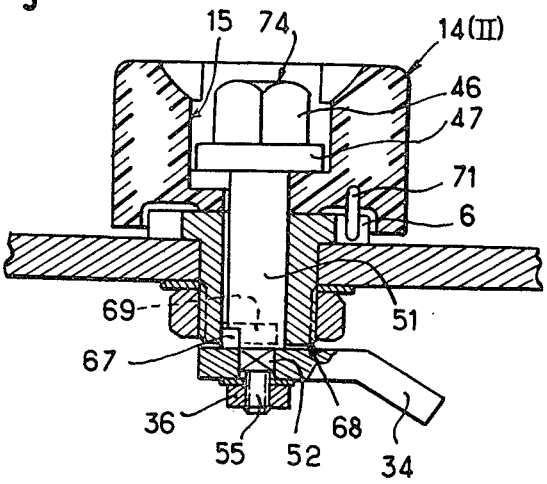
FIG. 6 shows a device the operation of which is only possible with the aid of a normal key.

Finally, in a last kind of setting up illustrated in FIG. 6, and for which the handle is placed in its second state, the lock operating member is constituted by a member 74 comprising a prismatic head 46 which can assume one of the shapes shown in FIGS. *7a,7b* or *7c*, a collar 47 and finally a cylindrical portion 51, a square 52 and a threaded portion 55 of the same dimensions as the similar members described in the preceding examples.

Figure 8:
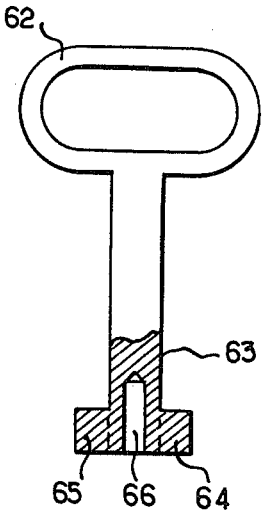
FIG. 8 shows a special type of normal key.

The head 46 which is placed, as well as the collar, in the housing 15 can likewise assume the shape 58,59,60,61 shown in axial view in FIG. *7d* in order to be able to be actuated by a normalised key by a stranger (62,63,64,65,66) such as that visible in FIG. 8 whilst the shapes 46,56,57 illustrated in FIGS. *7a,7b,7c* correspond to those which are normalised for certain applications or adopted in certain domains of industry.

In this latter kind of set up, in which the handle is immobilised, only the holder of an appropriate normalised key will be able to open the door.

Figure 9:
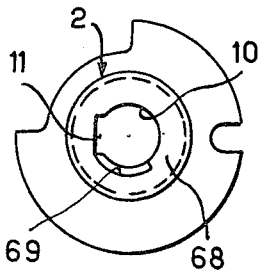
FIG. 9 shows an axial view of the bearing in a direction opposite to that of FIG. 3.

As the rotation of the lock operating member must be limited, it is necessary to dispose between this latter and the bearing, or between this latter and the handle, means appropriate therefor; the cylindrical portion 51, see FIG. 6, can for example comprise a lateral stop 67, moving in an angular cutaway 69 formed at the end 68 of the bearing, see likewise FIG. 9.

A bearing thus comprising both this circular groove 69 and the straight groove 11 is capable of receiving any one of the lock operating members described above.

This fastening device thus comprises only a limited number of elements amongst which, on the one hand, five (including nuts 13,36) are always of the same kind, and on the other hand only the sixth needs to be selected among a small number of models to fulfill the function which has been assigned to it.

I claim:

1. A fastening device for a door having inner and outer wall surfaces and an opening therethrough, said fastening device comprising: a bearing having a cylindrical body passing through the said opening, said cylindrical body having an internal diameter, first and second end portions and an annular collar integral with the said cylindrical body at the first end portion thereof, said cylindrical body having a threaded outer surface portion at the second end portion thereof and a nut cooperating with the said threaded surface portion, the said collar having a peripheral cutout extending over an angular sector thereof, the said nut engaging the said inner wall surface and securing the bearing in engagement with the said outer wall surface; an operating handle having a base plane wall portion and an opposite plane surface portion parallel to the base plane wall portion, the said base plane wall portion having a cylindrical opening which has an axis of symmetry at right angles with the said parallel surface portion, the diameter of the said cylindrical opening being substantially the same as the said internal diameter, the said handle further having a cylindrical housing coaxial with the said cylindrical opening and having a diameter which is larger than the diameter of the said cylindrical opening, said housing extending from the said base plane wall portion where it communicates with the said cylindrical opening to the said opposite plane surface portion where it opens; first and second slit-shaped cutouts provided in said handle in communication with said housing at two diametrically opposed regions thereof, said cutouts opening at said opposite plane surface portion, the said base plane wall portion having an inner surface which engages the said collar; a lock operating member having a cylindrical body pivoted in the said internal diameter of the bearing, said cylindrical body of the lock operating member having an inner end portion which projects from the second end of the said bearing; a latching member secured to the said inner end portion; and actuation means cooperating with the said lock operating member for rotating the said lock operating member through manual action.

2. A fastening device as claimed in claim 1, wherein the said annular collar has a further peripheral slot-shaped cutout and a pin, projecting from the outer surface of the said base plane wall portion in a direction substantially parallel to the said axis of symmetry, said pin being adapted to be removably secured to the said operating handle in a first position in which it penetrates through to said angular peripheral cut-out and allows for an angular displacement of the operating handle and in a second position in which it penetrates through to said slot-shaped cut-out and prevents any angular displacement of the operating handle.

3. A fastening device as claimed in claim 1, wherein the said base plane wall portion is provided with a radial notch.

4. A fastening device as claimed in claim 1, wherein the said cylindrical body of the bearing has an internal groove parallel to the axis of symmetry thereof.

5. A fastening device as claimed in claim 2, wherein the said actuating means include a further cylindrical body integrally connected to the cylindrical body of the said lock operating member, said further cylindrical body having substantially the same diameter as the said housing and being provided with first and second flat members radially projecting from said further cylindrical body and adapted respectively to engage the said first and second slit-shaped cut-outs.

6. A fastening device as claimed in claim 4, wherein the cylindrical body of the said lock operating member consists of a lock barrel provided with tumbler means and the said actuating means consist of a key which cooperates with the said lock barrel and has a head portion which is arranged for engaging the said first and second slit-shaped cut-outs, when the key is engaged into the lock barrel, the tumbler means being aranged for engaging the said groove when the key is removed from the lock barrel.

7. A fastening device as claimed in claims 3 or 4, wherein the cylindrical body of the said lock operating member consists of a lock barrel provided with tumbler means and the said actuating means consist of a key which cooperates with the said lock barrel and has a head portion which is arranged for engaging the said first and second slit-shaped cut-outs when the key is engaged into the lock barrel, the said lock barrel further having a radially projecting member which engages the said radial notch.

8. A fastening device as claimed in claims 2 or 4, wherein the said pin is permanently secured in its second position and the said actuating means comprise a key-actuated head member integrally connected to the cylindrical body of the said lock operating member.

* * * * *